US009518547B2

(12) United States Patent
John

(10) Patent No.: US 9,518,547 B2
(45) Date of Patent: Dec. 13, 2016

(54) FUEL INJECTOR INCLUDING EXTENSIONS FOR SPLIT SPRAY ANGLES

(71) Applicant: Caterpillar Inc., Peoria, IL (US)

(72) Inventor: Bobby John, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 34 days.

(21) Appl. No.: 14/706,448

(22) Filed: May 7, 2015

(65) Prior Publication Data

US 2016/0327000 A1 Nov. 10, 2016

(51) Int. Cl.
*F02M 61/18* (2006.01)
*F02M 61/14* (2006.01)

(52) U.S. Cl.
CPC ..... *F02M 61/14* (2013.01)

(58) Field of Classification Search
CPC ..... F02M 47/02; F02M 47/027; F02M 61/14; F02M 61/18; F02M 61/184; F02M 61/1846; F02M 61/1853; F02M 61/1866; F02M 61/1873
USPC ..... 123/294–301, 308, 432, 472, 531; 239/533.12, 533.2, 533.3
See application file for complete search history.

(56) References Cited

U.S. PATENT DOCUMENTS 5,062,573 A * 11/1991 Makimura ..... F02M 51/0675 239/533.12
5,150,691 A 9/1992 Imajo
5,224,458 A 7/1993 Okada et al.
5,499,769 A * 3/1996 Namiki ..... F02M 51/061 239/409
5,904,299 A * 5/1999 Hans ..... F02M 43/04 239/408
6,092,741 A * 7/2000 Sumida ..... F02M 51/0671 239/408
6,095,437 A 8/2000 Nozawa
7,574,992 B2 8/2009 Lohmann
2012/0186555 A1 7/2012 Mueller

FOREIGN PATENT DOCUMENTS

FR 2888618 A1 1/2007

* cited by examiner

*Primary Examiner* — John Kwon
*Assistant Examiner* — Johnny H Hoang
(74) *Attorney, Agent, or Firm* — Miller, Matthias & Hull LLP

(57) ABSTRACT

A fuel injector for an internal combustion engine is disclosed. The fuel injector includes a tip in fluid connection with a combustion chamber of the engine and includes an orifice for injecting fuel as a fuel jet. The fuel injector includes a protruding member in fluid connection with the first orifice extending from the tip at a protruding angle. The orifice injects the fuel jet into the first protruding member. The fuel injector includes a plurality of extension members in fluid connection with the protruding member and includes at least, a first extension member and a second extension member. The first and second extension members may extend from the protruding member at extension angles. The fuel jet may be distributed into, at least, a first distributed jet and a second distributed jet when the first fuel jet flows from the protruding member to the first plurality of extension members.

20 Claims, 7 Drawing Sheets

FUEL INJECTOR INCLUDING EXTENSIONS FOR SPLIT SPRAY ANGLES

TECHNICAL FIELD

The present disclosure generally relates to internal combustion engines and, more particularly, relates to fuel injectors for internal combustion engines.

BACKGROUND

Modern combustion engines may include one or more cylinders as part of the engine. The cylinder and an associated piston may define a combustion chamber therebetween. Within the combustion chamber, fuel for combustion is directly injected into the combustion chamber by, for example, a fuel injector, which is associated with the cylinder and has an orifice disposed such that it can directly inject fuel into the combustion chamber.

Different mixtures and/or equivalence ratios of the fuel/air mixture within the fuel jet may produce different results during combustion. The manners in which the injected fuel mixes and/or interacts with the air and other environmental elements of the combustion chamber may impact combustion processes and associated emissions. Further, if the fuel and air mixing is inadequate or the dispersion of said fuels is inconsistent, then suboptimal or abnormally large amounts of soot may form within the combustion chamber. Dispersion of fuel within the combustion chamber may be affected by the manner in which the fuel is injected into the combustion chamber by a fuel injector.

To aid in preventing or reducing soot formation and to increase efficiency in such combustion engines, systems and methods for altering fuel dispersion within a combustion chamber have been developed. For example, U.S. Patent Publication No. 2012/0186555 ("Ducted Combustion Chamber for Direct Injection Engines and Method") discloses ducted combustion within a combustion engine, which may affect mixing and dispersion of fuel within a combustion chamber. The ducts of the '555 application ducts may form a passageway corresponding to an orifice of the fuel injector, into which fuel jets are injected. The fuel jets may be channeled into the ducts, which may improve fuel combustion because upstream regions of a direct-injected fuel jet may be affected by faster and more uniform mixing.

While the teachings of the '555 application are advantageous in providing an improved fuel/air mixture, further improvements in fuel/air mixtures and charge utilization of said fuel are always desired, as such improvements may further reduce emissions and soot formation. Improvements may be made to the fuel injector to improve fuel/air mixing, rather than, or in addition to, utilizing ducted combustion. Therefore, fuel injectors utilizing extensions at split spray angles, which may improve dispersion of fuel in a combustion chamber, are desired.

SUMMARY

In accordance with one aspect of the disclosure, a fuel injector for an internal combustion engine is disclosed. The internal combustion engine may include a combustion chamber. The fuel injector may include a tip in fluid connection with the combustion chamber, the tip including a first orifice for injecting fuel as a first fuel jet. The fuel injector may include a first protruding member in fluid connection with the first orifice and having a first opening end proximate to the first orifice and a first opposing end, the first protruding member extending from the tip at a first protruding angle, the first protruding angle defined between a first protruding axis of the first protruding member and a center axis of the tip, the first orifice injecting the first fuel jet into the first protruding member. The fuel injector may further include a first plurality of extension members in fluid connection with the first protruding member and extending from the first opposing end. The first plurality of extension members may include, at least, a first extension member and a second extension member. The first extension member may extend from the first opposing end at a first extension angle, the first extension angle defined between the first protruding axis and a first extension axis. The second extension member may extend from the first opposing end at a second extension angle, the second extension angle defined between the first protruding axis and a second extension axis. The first fuel jet may be distributed into, at least, a first distributed jet and a second distributed jet when the first fuel jet flows from the first protruding member to the first plurality of extension members, the first distributed jet flowing through the first extension member and the second distributed jet flowing through the second extension member.

In accordance with another aspect of the disclosure, an internal combustion engine is disclosed. The internal combustion engine may include an engine block having at least one cylinder bore and a cylinder head having a flame deck surface disposed at one end of the cylinder bore. The internal combustion may further include a piston connected to a crankshaft and configured to reciprocate within the cylinder bore, the piston having a piston top surface facing the flame deck surface such that a combustion chamber is defined within the cylinder bore bound at a first end by the flame deck surface and at a second end by the piston top surface. The internal combustion engine may include a fuel injector. The fuel injector may include a tip in fluid connection with the combustion chamber, the tip including a first orifice for injecting fuel as a first fuel jet. The fuel injector may include a first protruding member in fluid connection with the first orifice and having a first opening end proximate to the first orifice and a first opposing end, the first protruding member extending from the tip at a first protruding angle, the first protruding angle defined between a first protruding axis of the first protruding member and a center axis of the tip, the first orifice injecting the first fuel jet into the first protruding member. The fuel injector may further include a first plurality of extension members in fluid connection with the first protruding member and extending from the first opposing end. The first plurality of extension members may include, at least, a first extension member and a second extension member. The first extension member may extend from the first opposing end at a first extension angle, the first extension angle defined between the first protruding axis and a first extension axis. The second extension member may extend from the first protruding opposing end at a second extension angle, the second extension angle defined between the first protruding axis and a second extension axis. The first fuel jet may be distributed into, at least, a first distributed jet and a second distributed jet when the first fuel jet flows from the first protruding member to the first plurality of extension members, the first distributed jet flowing through the first extension member and the second distributed jet flowing through the second extension member.

In accordance with yet another aspect of the disclosure, a method for operating a combustion system is disclosed. The combustion system may include a fuel injector having a tip in fluid connection with a combustion chamber. The method may include injecting a first fuel jet from an orifice associated with the tip into a first protruding member of the fuel injector. The method may include directing the first fuel jet through the first protruding member, the first protruding member having a first opening end proximate to the first orifice and a first opposing end, the first protruding member extending from the tip at a first protruding angle, the first protruding angle defined between a first protruding axis of the first protruding member and a center axis of the tip. The method may further include directing the first fuel jet from first opening end to a plurality of extension members in fluid connection with the first protruding member and extending from the first opposing end. The first plurality of extension members may include, at least, a first extension member extending from the first opposing end at a first extension angle, the first extension angle defined between the first protruding axis and a first extension axis and a second extension member extending from the first opposing end at a second extension angle, the second extension angle defined between the first protruding axis and a second extension axis. The method may further include distributing the first fuel jet into, at least, a first distributed jet and a second distributed jet using the plurality of extension members. The method may further include directing, at least, the first distributed jet and the second distributed jet into the combustion chamber.

Other features and advantages of the disclosed systems and principles will become apparent from reading the following detailed disclosure in conjunction with the included drawing figures.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

Figure 1:
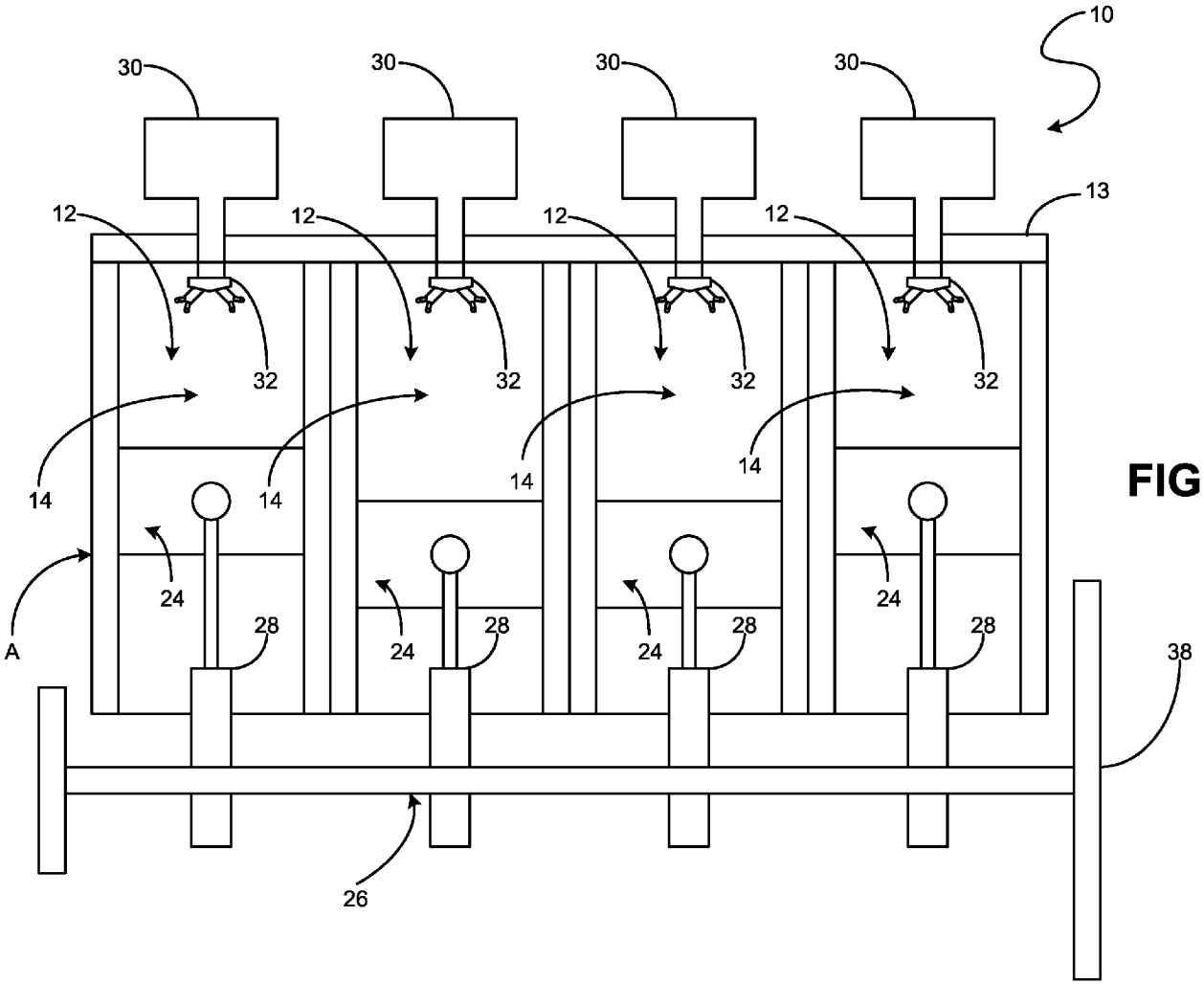
FIG. 1 is a side cross-sectional view of an internal combustion engine, in accordance with an embodiment of the present disclosure.

Turning now to the drawings and with specific reference to FIG. 1, a combustion engine 10 is shown. The engine 10 may be an internal combustion engine having a plurality of cylinders 12. For example, the cylinders 12 may be defined as cylinder bores within an engine block 13 of the engine 10. Each of the plurality of cylinders 12 includes a combustion chamber 14. Each combustion chamber 14 may have a generally cylindrical shape, in accordance with the general shape of the cylinder 12.

Figure 2:
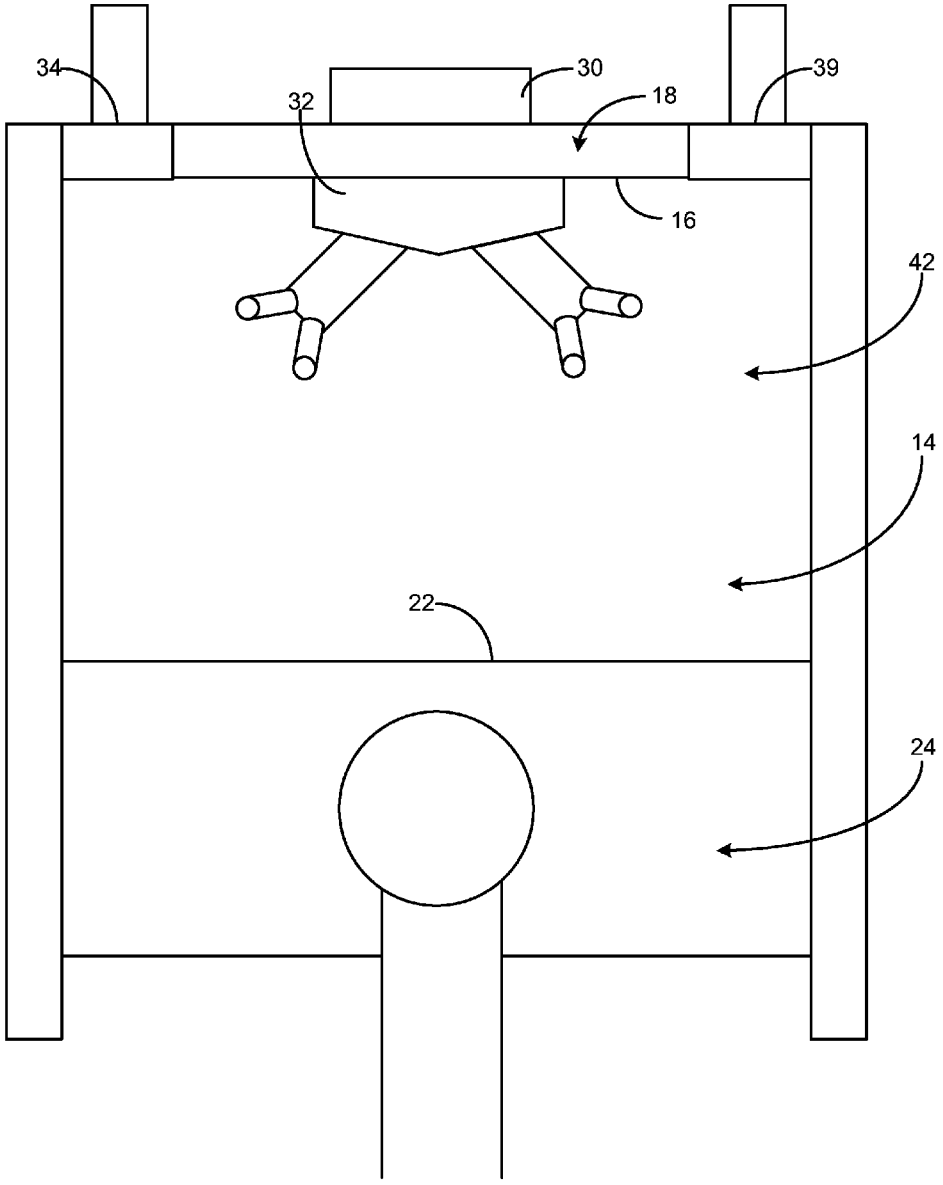
FIG. 2 is a front, cross-sectional view of a cylinder of the internal combustion engine of FIG. 1, as shown taken from the reference notation "A" of FIG. 1, in accordance with the present disclosure.

The combustion chamber 14 is shown in greater detail in the front, cross-sectional view of FIG. 2. As shown in FIG. 2, and with continued reference to FIG. 1, the combustion chamber 14 may be bound at one end by a flame deck surface 16 of a cylinder head 18 of each cylinder 12. The combustion chamber 14 may be further bound at a second end by a piston top surface 22 of a piston 24. The piston 24 is reciprocally disposed within the bore and, as shown in FIG. 1, is connected to a crankshaft 26 via a connecting rod 28. A fuel injector 30 is in fluid connection with the combustion chamber 14 and may be mounted in the cylinder head 18. The fuel injector 30 includes a tip 32 that protrudes within the combustion chamber 14 through the flame deck surface 16. Therefore, the fuel injector 30, via the tip 32, can directly inject fuel into the combustion chamber 14 as, for example, one or more fuel jets.

During operation of the engine 10, air enters the combustion chamber 14 via one or more intake valves 34 (shown in FIG. 2). Air is able to enter the combustion chamber 14 when the intake valves 34 are open during an intake stroke and/or at the end of an exhaust stroke and/or at the beginning of a compression stroke. When air is present in the combustion chamber 14, the fuel injector 30, via the tip 32, will inject high pressure fuel through orifices 36 of the tip 32 as fuel jets. The fuel jets may generally disperse within the combustion chamber 14 to create a fuel/air mixture within the combustion chamber 14. Ignition produces combustion, which, in turn, provides work on the piston 24 to produce motion upon the crankshaft 26 to drive an output 38. Following combustion, exhaust gas may be expelled from the combustion chamber 14 via one or more exhaust valves 39, when said exhaust valves 39 are open during an exhaust stroke and/or at the end of a power stroke and/or at the beginning of an intake stroke of the engine 10.

Within the combustion chamber 14, charge utilization may be relevant to the combustion efficiency and may be relevant to the amount and type of combustion byproducts that are formed. For example, if the fuel/air mixture is too rich in fuel due to insufficient charge utilization within the combustion chamber, then higher soot emissions may occur within the combustion chamber 14 and/or combustion efficiency may be affected. However, protruding members (e.g., a protruding member 40) and associated extension members (e.g., a first extension member 41 and a second extension member 42) of the fuel injector 30 disposed within the combustion chamber 14 may split fuel jets to achieve optimized air utilization and atomization.

Figure 3:
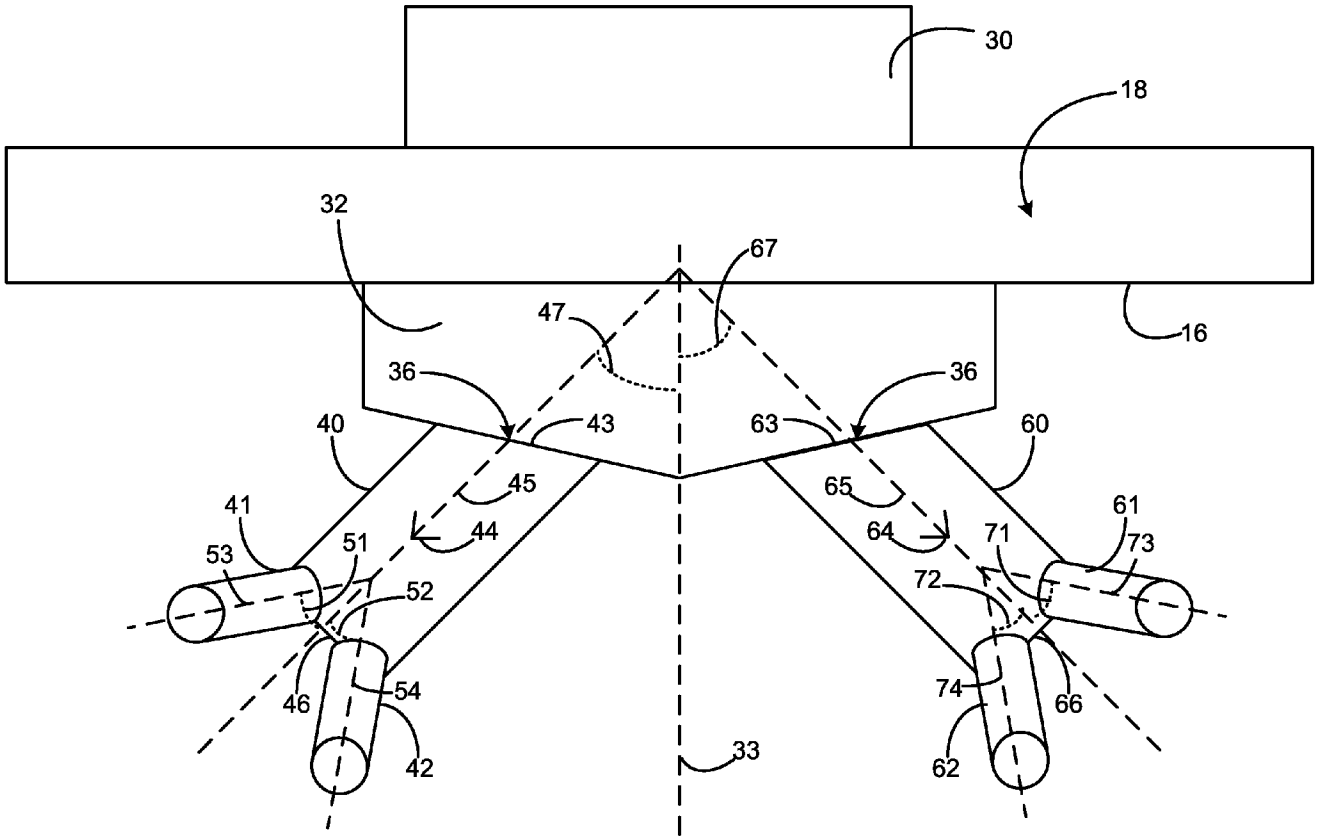
FIG. 3 is a side view of a fuel injector tip including protruding and extension members, in accordance with an embodiment of the present disclosure.

To further illustrate the injector tip 32 and its associated protruding member(s) 40 and extension members 41,42, within the combustion chamber 14, such elements are shown in greater detail in FIG. 3. The protruding member 40 is connected, in fluid communication, with the orifice 36 at an opening end 43. Fuel from the fuel jet may enter the protruding member 40 at the opening end 43 and flow in a flow direction 44, along a protruding axis 45, towards an opposing end 46. The protruding member 40 may extend from the tip 32 at a protruding angle 47, which may be defined as an angle between a tip center axis 33 and the protruding axis 45.

To further distribute fuel injected into the protruding member 40 in different angles, the first and second extension members 41, 42 are included and extend from the opposing end 46 of the protruding member 40. The first extension member 41 extends from the opposing end 46 at a first extension angle 51, which is defined between the protruding axis 45 and a first extension axis 53. Similarly, the second extension member 42 extends from the opposing end 46 at a second extension angle 52, which is defined between the protruding axis 45 and the a second extension axis 54. While only the first and second extension member 41,42 are shown, the fuel injector 30 may include any number of extension members as deemed necessary to optimize charge utilization within the combustion chamber 14.

Figure 4:
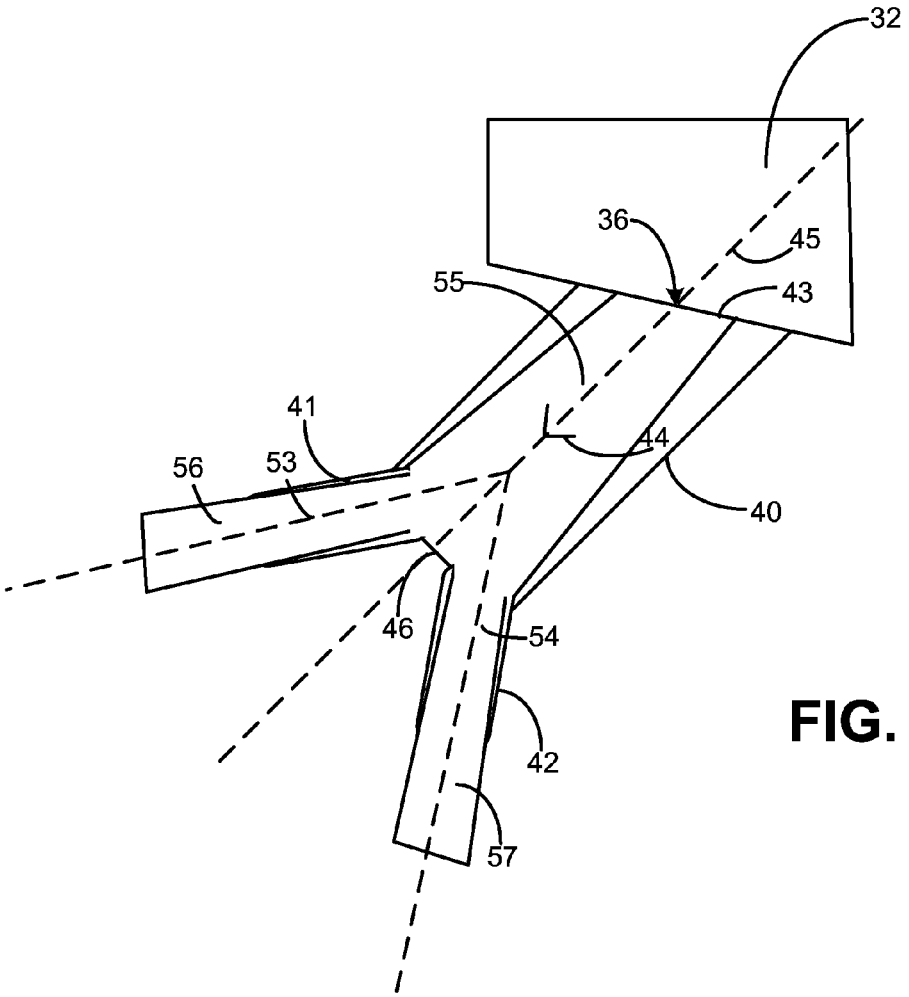
FIG. 4 is a cross-sectional side view of a fuel injector tip including protruding and extension members and having a fuel jet injected therefrom, in accordance with the embodiment of FIG. 3 and the present disclosure.

Turning now to FIG. 4 and with continued reference to FIG. 3, a cross sectional view of elements of the FIG. 3 are shown, wherein a fuel jet 55 is shown injected into the protruding member 40 along the protruding axis 45. When the fuel jet 55 flows to the opposing end 46 of the protruding member 40, it is distributed into first and second distributed jets 56, 57 as the fuel jet 55 enters the first and second extension members 41, 42. The first distributed jet 56 flows through the first extension member 41 into the combustion chamber 14, while the second distributed jet 57 flows through the second extension member 42 into the combustion chamber 14.

Returning to FIG. 3, a second protruding member 60 may be included and may be connected, in fluid communication, with an orifice 36 at a second opening end 63. Fuel from the fuel jet may enter the second protruding member 60 at the second opening end 63 and flow in a second flow direction 64, along a second protruding axis 65, towards a second opposing end 66. The second protruding member 60 may extend from the tip 32 at a second protruding angle 67, which may be defined as an angle between the tip center axis 33 and the second protruding axis 65.

To further distribute fuel injected into the protruding member 60 at different angles, third and fourth extension members 61, 62 may be included and extend from the second opposing end 66 of the second protruding member 60. The third extension member 61 extends from the second opposing end 66 at a third extension angle 71, which is defined between the second protruding axis 65 and a third extension axis 73. Similarly, the fourth extension member 62 extends from the opposing end 66 at a fourth extension angle 72, which is defined between the protruding axis 65 and the a second extension axis 74. When a fuel jet is injected into the second protruding member 60, it may distribute the fuel jet into third and fourth distributed jets, similar to the distribution shown in FIG. 4 and described above.

The protruding angle 47, the second protruding angle 67, the first extension angle 51, the second extension angle 52, the third extension angle 71, the fourth extension angle 72, and/or any other angle for positioning any additional protruding members or extension members may all have any value, similar to one another or different from one another. All of the angles may be specifically configured such that charge utilization is optimized within the combustion chamber 14. Optimization of charge utilization and atomization may result in better efficiency and lower emissions for the engine 10.

While it may not be explicitly shown in the drawings, any or all of the extension members 41, 42, 61, 62 may be horizontally coplanar with respect to the tip center axis 33.

Similarly, the protruding members 40, 60 and the extension members 41, 42, 61, 62 may all have similar or differing lengths, which all may be altered to optimize charge utilization. Also, the protruding members 40, 60 and the extension members 41, 42, 61, 62 may all have similar or differing diameters, which all may be altered to optimize charge utilization. Infinite configurations of the disclosed embodiments are possible, as the angles, lengths, and diameters of protruding members and extension members can vary and can vary independently.

In some example embodiments disclosed herein, the members of the fuel injector (e.g., the protruding members 40, 60 and the extension members 41, 42, 61, 62) may converge and/or diverge in a flow direction of a fuel jets, (e.g., the fuel jet 55). A divergent member may diverge in a flow direction of the fuel jets. "Divergence in a flow direction of the fuel jets," as defined herein with reference to protruding and extension members, generally refers to a member having a width that increases along the length of the member in the general direction of the flow of a fuel jet therein. Using divergent members may alter the dispersion of the fuel jets.

Alternatively, a member may have a convergent structure, wherein the convergent structure converges in a flow direction of the fuel jet. "Converge in a flow direction of the fuel jets," as defined herein with reference to such members, generally refers to a member having a width that decreases along the length of the structure in the general direction of the flow of the fuel jet. Using convergent members may alter the dispersion of the fuel jets. Divergent and convergent shaped members may be used in any of the proceeding embodiments shown in FIGS. 3-7, as well.

Figure 5:
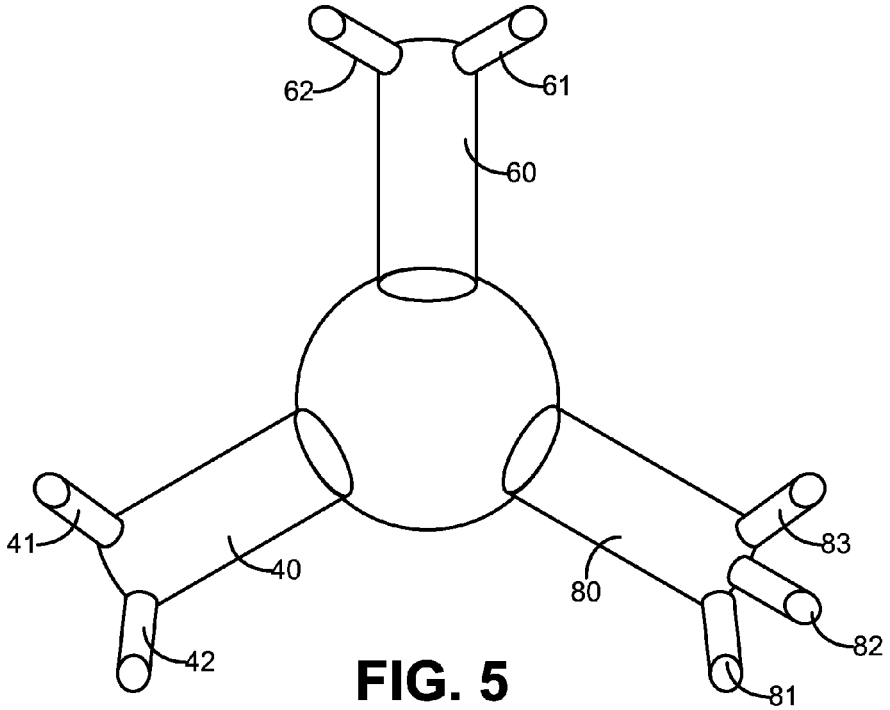
FIG. 5 is a top view of a fuel injector tip including protruding and extension members, in accordance with another embodiment of the present disclosure.
Figure 6:
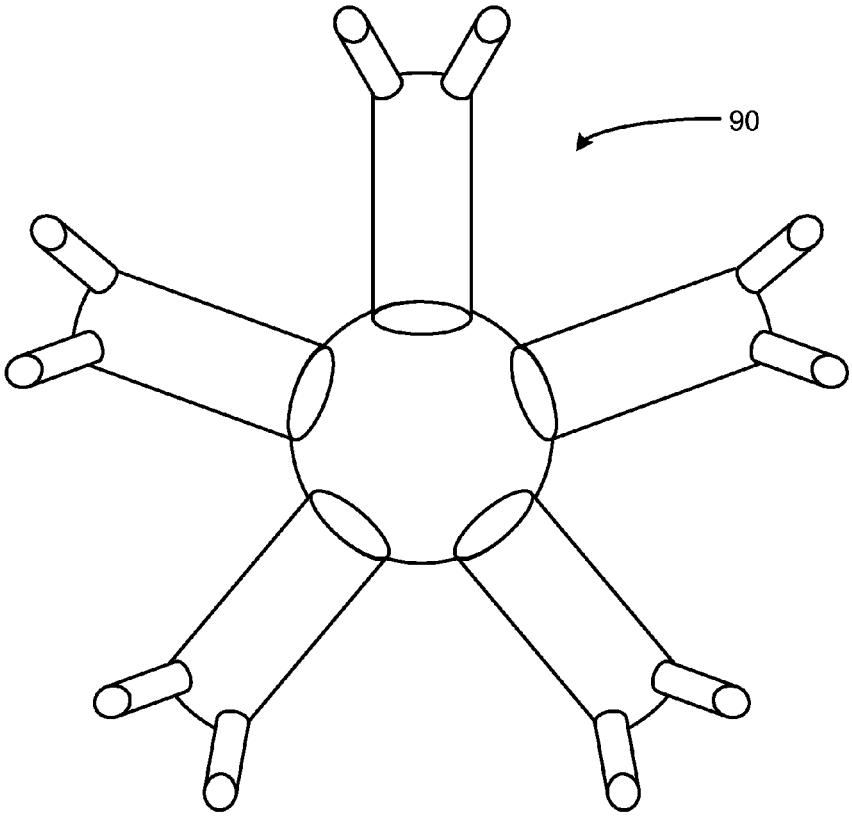
FIG. 6 is a top view of a fuel injector tip including protruding and extension members, in accordance with yet another embodiment of the present disclosure.

Further, as shown in the top view of the injector tip 32 in FIG. 5, the fuel injector 30 may include further protruding members and extension members. For example, FIG. 5 shows a third protruding member 80, which is in fluid communication with an orifice 36 of the injector tip 32. The third protruding member 80 has similar characteristics to those of the first and second protruding members 40, 60. As shown, the third protruding member 80 includes fifth, sixth, and seventh extension members 81, 82, 83. The fuel injector 30 may include any number of protruding members and extension members as needed and, of course, an infinite number of member configurations are possible (e.g., the five protruding member by two extension member configuration 90 of FIG. 6).

Figure 7:
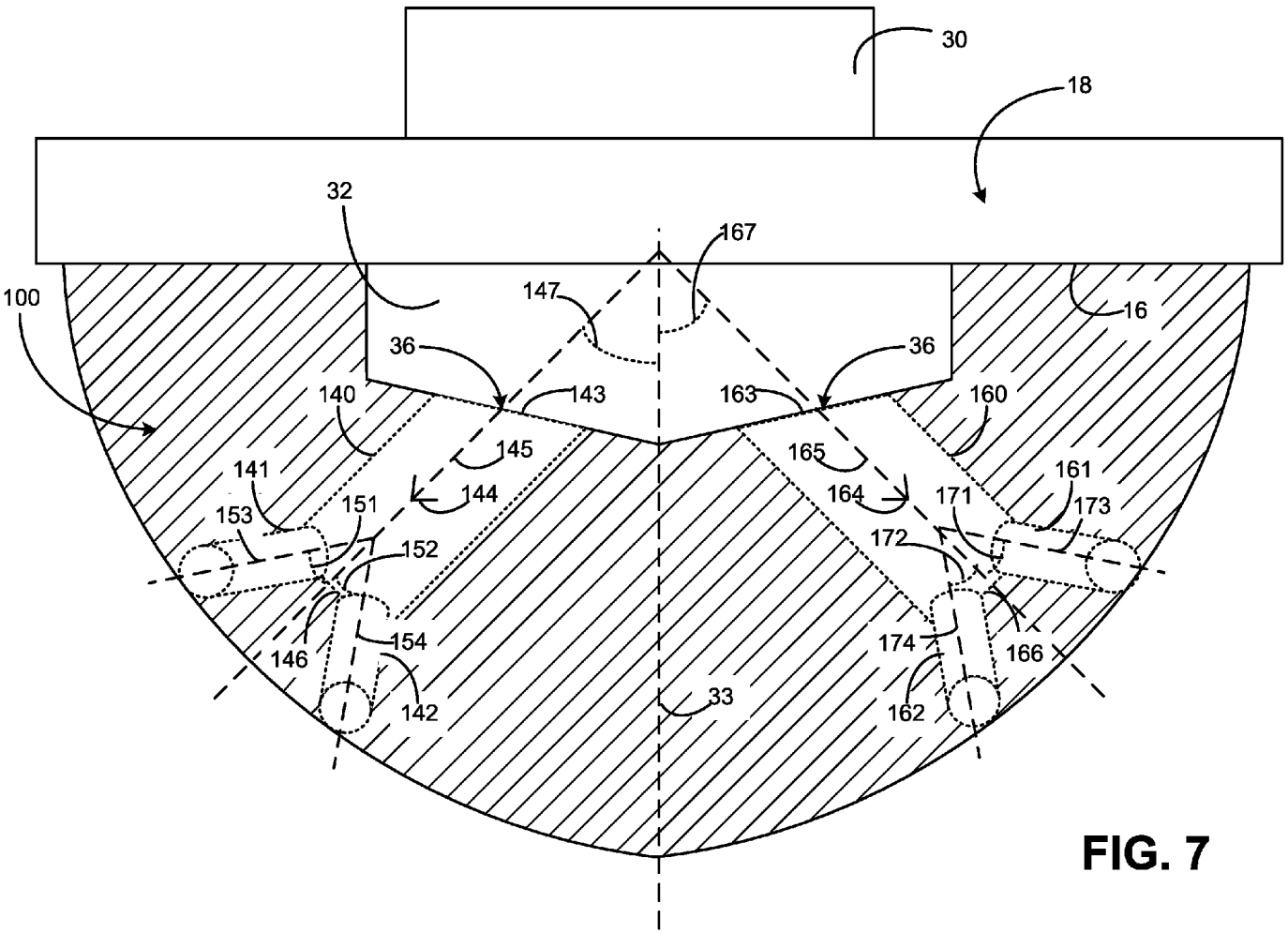
FIG. 7 is a side, cross-sectional view of a tip attachment used in conjunction with a fuel injector tip, in accordance with an embodiment of the present disclosure.
Figure 8:
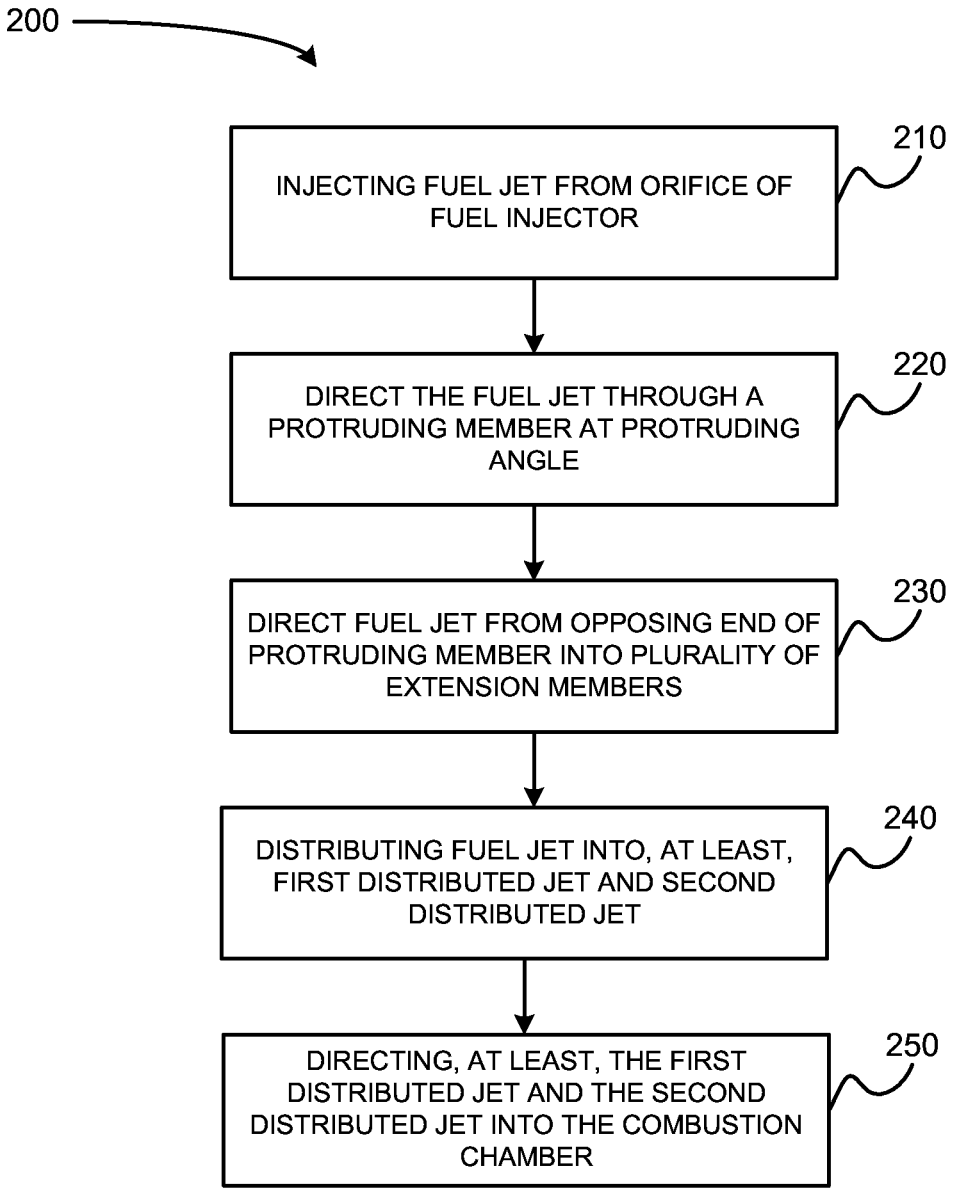
FIG. 8 is a block diagram of a flowchart representative of a method for operating a combustion system, in accordance with an embodiment of the disclosure.

Turning now to FIG. 7, another embodiment is shown illustrating the injector tip 32 and its associated protruding member(s) 140 and extension members 141,142, within the combustion chamber 14. In the embodiment of FIG. 7, the fuel injector 30 includes a tip attachment 100, which may be machined directly onto the tip 32 and/or the fuel injector 30, generally. Alternatively, the tip attachment 100 may be machined independent of the tip 32 and/or the fuel injector and may be later attached to the tip 32. In such examples, the tip attachment 100 may be manufactured using additive manufacturing systems and methods, such as, for example, three-dimensional (3-D) printing. The tip attachment is a solid structure that defines any number of protruding members and extension members, such as, but not limited to, protruding members 140, 160 and extension members 141, 142, 161, 162, as shown. However, the tip attachment 100 is not limited to only including the protruding members 140, 160 and the extension members 141, 142, 161, 162 and may include any additional members for optimizing charge utilization in the combustion chamber 14.

The protruding member 140 is connected, in fluid communication, with the orifice 36 at an opening end 143. Fuel from the fuel jet may enter the protruding member 140 at the opening end 143 and flow in a flow direction 144, along a protruding axis 145, towards an opposing end 146. The protruding member 140 may extend from the tip 32 at a protruding angle 147, which may be defined as an angle between a tip center axis 33 and the protruding axis 145.

To further distribute fuel injected into the protruding member 140 in different angles, the first and second extension members 141, 142 are included and extend from the opposing end 146 of the protruding member 140. The first extension member 41 extends from the opposing end 146 at a first extension angle 151, which is defined between the protruding axis 145 and a first extension axis 153. Similarly, the second extension member 142 extends from the opposing end 146 at a second extension angle 152, which is defined between the protruding axis 145 and the a second extension axis 154. While only the first and second extension member 141,142 are shown, the fuel injector 30 may include any number of extension members as deemed necessary to optimize charge utilization within the combustion chamber 14.

Similar to the fuel jet interaction shown in FIG. 4, a fuel jet may be injected into the protruding member 140 along the protruding axis 145. When such a fuel jet flows to the opposing end 146 of the protruding member 140, it is distributed into first and second distributed jets as the fuel jet enters the first and second extension members 41, 42. The first distributed jet flows through the first extension member 141 into the combustion chamber 14, while the second distributed jet flows through the second extension member 142 into the combustion chamber 14.

A second protruding member 160 may be included and may be connected, in fluid communication, with an orifice 36 at a second opening end 163. Fuel from the fuel jet may enter the second protruding member 160 at the second opening end 163 and flow in a second flow direction 164, along a second protruding axis 165, towards a second opposing end 166. The second protruding member 160 may extend from the tip 32 at a second protruding angle 167, which may be defined as an angle between the tip center axis 33 and the second protruding axis 165.

To further distribute fuel injected into the protruding member 160 at different angles, third and fourth extension members 161, 162 may be included and extend from the second opposing end 166 of the second protruding member 160. The third extension member 161 extends from the second opposing end 166 at a third extension angle 171, which is defined between the second protruding axis 165 and a third extension axis 173. Similarly, the fourth extension member 162 extends from the opposing end 166 at a fourth extension angle 172, which is defined between the protruding axis 165 and the a second extension axis 174. When a fuel jet is injected into the second protruding member 160, it may distribute the fuel jet into third and fourth distributed jets, similar to the distribution shown in FIG. 4 and described above.

The protruding angle 147, the second protruding angle 167, the first extension angle 151, the second extension angle 152, the third extension angle 171, the fourth extension angle 172, and/or any other angle for positioning any additional protruding members or extension members may all have any value, similar to one another or different from one another. All of the angles may be specifically configured such that charge utilization is optimized within the combustion chamber 14. Optimizing charge utilization and atomization may result in better efficiency and lower emissions for the engine 10.

Similarly, the protruding members 140, 160 and the extension members 141, 142, 161, 162 may all have similar or differing lengths, which all may be altered to optimize charge utilization. Also, the protruding members 140, 160 and the extension members 141, 142, 161,1 62 may all have similar or differing diameters, which all may be altered to optimize charge utilization. Infinite configurations of the disclosed embodiments are possible, as the angles, lengths, and diameters of protruding members and extension members can vary and can vary independently.

INDUSTRIAL APPLICABILITY

The present disclosure relates generally to internal combustion engines and, more specifically, to fuel injectors for combustion engines. While the present disclosure shows the embodiments as related to internal combustion engines having reciprocating pistons, the teachings of the disclosure are certainly applicable to other combustion systems, which utilize diffusion or non-premixed flames, such as gas turbines, industrial burners, and the like.

Within the combustion chamber 14, charge utilization may be relevant to the combustion efficiency and may be relevant to the amount and type of combustion byproducts that are formed. For example, if the fuel/air mixture is too rich in fuel due to insufficient charge utilization within the combustion chamber, then higher soot emissions may occur within a combustion chamber and/or combustion efficiency may be affected. However, protruding members (e.g., the protruding member 40) and associated extension members (e.g., the first extension member 41 and the second extension member 42) of the fuel injector 30 disposed within the combustion chamber 14 may split fuel jets to achieve optimized air utilization and atomization.

An example method utilizing the fuel injectors shown in FIGS. 1-7 and described above is exemplified in the flowchart of FIG. 10, which represents a method 200 for operating a combustion system. While the description of the method 200, generally, refers to the elements of FIGS. 3-4, the method 200 may be replicated using any of the embodiments of FIGS. 1-7. The method 200 begins at block 210, wherein a fuel jet 55 is injected from an orifice 36 of the fuel injector tip 32 into the protruding member 40. The fuel jet 55 is then directed through the protruding member 40 from the opening end 43, wherein the protruding member extends from the tip 32 at the protruding angle 47, as shown in block 220.

The fuel jet 55 then is directed from the opposing end 46 to the one or more extension members, such as first and second extension members 41, 42, as shown in block 430. The extension member 41 extends from the opposing end 46 at the extension angle 51 and the second extension member 42 extends from the opposing end 46 at the second extension angle 52. The fuel is then distributed to the extension members 41, 42 as first and second distributed jets 56, 57 (block 440), which are then distributed to the combustion chamber 14 (block 450). The method 200 may be utilized concurrently using other fuel jets injected out of other orifices 36 into additional members (e.g., the second protruding member 60 and its associated extension members 61, 62).

It will be appreciated that the present disclosure provides fuel injectors having split spray angles, internal combustion engines utilizing fuel injectors having split spray angles, and methods for operating combustion systems utilizing fuel injectors having split spray angles. While only certain embodiments have been set forth, alternatives and modifications will be apparent from the above description to those skilled in the art. These and other alternatives are considered equivalents and within the spirit and scope of this disclosure and the appended claims.

What is claimed is:

1. A fuel injector for an internal combustion engine, the internal combustion engine including a combustion chamber, the fuel injector comprising:

a tip in fluid connection with the combustion chamber, the tip including a first orifice for injecting fuel as a first fuel jet; and a first protruding member in fluid connection with the first orifice and having a first opening end proximate to the first orifice and a first opposing end, the first protruding member extending from the tip at a first protruding angle, the first protruding angle defined between a first protruding axis of the first protruding member and a center axis of the tip, the first orifice injecting the first fuel jet into the first protruding member; and a first plurality of extension members in fluid connection with the first protruding member and extending from the first opposing end, the first plurality of extension members including, at least:

a first extension member extending from the first opposing end at a first extension angle, the first extension angle defined between the first protruding axis and a first extension axis; and a second extension member extending from the first opposing end at a second extension angle, the second extension angle defined between the first protruding axis and a second extension axis; and wherein the first fuel jet is distributed into, at least, a first distributed jet and a second distributed jet when the first fuel jet flows from the first protruding member to the first plurality of extension members, the first distributed jet flowing through the first extension member and the second distributed jet flowing through the second extension member.

2. The fuel injector of claim 1, further comprising a second protruding member in fluid connection with a second orifice of the tip and having a second opening end proximate to the second orifice and a second opposing end, the second protruding member extending from the tip at a second protruding angle, the second protruding angle defined between a second protruding axis of the second protruding member and the center axis of the tip, the second orifice injecting a second fuel jet into the second protruding member.

3. The fuel injector of claim 2, further comprising a second plurality of extension members in fluid connection with the second protruding member and extending from the second opposing end, the second plurality of extension members including, at least:

a third extension member extending from the second opposing end at a third extension angle, the third extension angle defined between the second protruding axis and a third extension axis; and a fourth extension member extending from the second opposing end at a fourth extension angle, the fourth extension angle defined between the second protruding axis and a fourth extension axis; and wherein the second fuel jet is divided into, at least, a third distributed jet and a fourth distributed jet when the second fuel jet flows from the second protruding member to the second plurality of extension members, the third distributed jet flowing through the third extension member and the fourth distributed jet flowing through the fourth extension member.

4. The fuel injector of claim 1, wherein the first plurality of extension members further includes, at least, a third extension member extending from the first opposing end at a third extension angle, the third extension angle defined between the first protruding axis and a third extension axis.

5. The fuel injector of claim 1, further comprising a tip attachment, the tip attachment defining the first protruding member and the first plurality of extension members as bores through which the first fuel jet, first distributed jet, and second distributed jet are injected.

6. The fuel injector of claim 5, further comprising a second protruding member in fluid communication with a second orifice of the tip and having a second opening end proximate to the second orifice and a second opposing end, the second protruding member extending from the tip at a second protruding angle, the second protruding angle defined between a second protruding axis of the second protruding member and the center axis of the tip, the second orifice injecting the second fuel jet into the second protruding member, wherein the second protruding member is defined by the tip attachment as a bore through which the second fuel jet is injected.

7. The fuel injector of claim 6, further comprising a second plurality of extension members in fluid connection with the second protruding member and extending from the second opposing end, the second plurality of extension members including, at least:

a third extension member extending from the second opposing end at a third extension angle, the third extension angle defined between the second protruding axis and a third extension axis; and a fourth extension member extending from the second opposing end at a fourth extension angle, the fourth extension angle defined between the second protruding axis and a fourth extension axis;

wherein the second fuel jet is distributed into, at least, a third distributed jet and a fourth distributed jet when the second fuel jet flows from the second protruding member to the second plurality of extension members, the third distributed jet flowing through the third extension member and the fourth distributed jet flowing through the fourth extension member; and wherein the second plurality of extensions is defined by the tip attachment as a plurality of bores through which the second fuel jet is injected as, at least, the third and fourth distributed jets.

8. The fuel injector of claim 5, wherein the tip attachment is formed by three-dimensional (3-D) printing.

9. The fuel injector of claim 1, wherein the first protruding member is a generally diverging shaped protruding member, the generally diverging shaped protruding member diverging about the first protruding axis in a flow direction of the first fuel jet.

10. The fuel injector of claim 1, wherein the first protruding member is a generally converging shaped protruding member, the generally converging shaped protruding member converging about the first protruding axis in a flow direction of the first fuel jet.

11. The fuel injector of claim 1, wherein the first protruding member is a generally diverging shaped extension member, the generally diverging shaped extension member diverging about the first extension axis in a flow direction of the first distributed jet.

12. The fuel injector of claim 1, wherein the first extension member is a generally converging shaped extension member, the generally converging shaped extension member converging about the first extension axis in a flow direction of the first distributed jet.

13. The fuel injector of claim 1, wherein the first extension member is a generally diverging shaped extension member, the generally diverging shaped extension member diverging about the first extension axis in a flow direction of the first distributed jet.

14. The fuel injector of claim 1, wherein the first extension member and the second extension member are horizontally coplanar with respect to the center axis of the tip.

15. An internal combustion engine, comprising:

an engine block having at least one cylinder bore;

a cylinder head having a flame deck surface disposed at one end of the cylinder bore;

a piston connected to a crankshaft and configured to reciprocate within the cylinder bore, the piston having a piston top surface facing the flame deck surface such that a combustion chamber is defined within the cylinder bore bound at a first end by the flame deck surface and at a second end by the piston top surface; and a fuel injector including:

a tip in fluid connection with the combustion chamber, the tip including a first orifice for injecting fuel as a first fuel jet; and a first protruding member in fluid communication with the first orifice and having a first opening end proximate to the first orifice and a first opposing end, the first protruding member extending from the tip at a first protruding angle, the first protruding angle defined between a first protruding axis of the first protruding member and a center axis of the tip, the first orifice injecting the first fuel jet into the first protruding member; and a first plurality of extension members in fluid connection with the first protruding member and extending from the first opposing end, the first plurality of extension members including, at least:

a first extension member extending from the first opposing end at a first extension angle, the first extension angle defined between the first protruding axis and a first extension axis; and a second extension member extending from the first opposing end at a second extension angle, the second extension angle defined between the first protruding axis and a second extension axis;

wherein the first fuel jet is distributed into, at least, a first distributed jet and a second distributed jet when the first fuel jet flows from the first protruding member to the first plurality of extension members, the first distributed jet flowing through the first extension member and the second distributed jet flowing through the second extension member.

16. The internal combustion engine of claim 15, wherein the fuel injector further includes a tip attachment, the tip attachment defining the first protruding member and the first plurality of extension members as bores through which the first fuel jet, first distributed jet, and second distributed jet are injected.

17. The internal combustion engine of claim 15, wherein the fuel injector further includes a second protruding member in fluid connection with a second orifice and having a second opening end proximate to the second orifice and a second opposing end, the second protruding member extending from the tip at a second protruding angle, the second protruding angle defined between a second protruding axis of the second protruding member and the center axis of the tip, the second orifice injecting a second fuel jet into the second protruding member.

18. The internal combustion engine of claim 17, wherein the fuel injector further includes a second plurality of extension members in fluid connection with the second protruding member and extending from the second opposing end, the second plurality of extension members including, at least:

a third extension member extending from the second protruding opposing end at a third extension angle, the third extension angle defined between the second protruding axis and a third extension axis; and a fourth extension member extending from the second protruding opposing end at a fourth extension angle, the fourth extension angle defined between the second protruding axis and a fourth extension axis; and wherein the second fuel jet is divided into, at least, a third distributed jet and a fourth distributed jet when the second fuel jet flows from the second protruding member to the second plurality of extension members, the third distributed jet flowing through the third extension member and the fourth distributed jet flowing through the fourth extension member.

19. A method for operating a combustion system, the combustion system including a fuel injector having a tip in fluid connection with a combustion chamber, the method comprising:

injecting a first fuel jet from an orifice associated with the tip into a first protruding member of the fuel injector;

directing the first fuel jet through the first protruding member, the first protruding member having a first opening end proximate to the first orifice and a first opposing end, the first protruding member extending from the tip at a first protruding angle, the first protruding angle defined between a first protruding axis of the first protruding member and a center axis of the tip;

directing the first fuel jet from first opposing end to a plurality of extension members in fluid connection with the first protruding member and extending from the first opposing end, the first plurality of extension members including, at least, a first extension member extending from the first opposing end at a first extension angle, the first extension angle defined between the first protruding axis and a first extension axis; and a second extension member extending from the first opposing end at a second extension angle, the second extension angle defined between the first protruding axis and a second extension axis;

distributing the first fuel jet into, at least, a first distributed jet and a second distributed jet using the plurality of extension members; and directing, at least, the first distributed jet and the second distributed jet into the combustion chamber.

20. The method of claim 19, further comprising:

injecting a second fuel jet from a second orifice associated with the tip into a second protruding member of the fuel injector;

directing the second fuel jet through the second protruding member, the second protruding member having a second opening end proximate to the second orifice and a second opposing end, the second protruding member extending from the tip at a second protruding angle, the second protruding angle defined between a second protruding axis of the second protruding member and a center axis of the tip;

directing the second fuel jet from second opposing end to a plurality of extension members in fluid connection with the second protruding member and extending from the second opposing end, the second plurality of extension members including, at least, a third extension member extending from the second opposing end at a third extension angle, the third extension angle defined between the second protruding axis and a third extension axis; and a fourth extension member extending from the second opposing end at a fourth extension angle, the fourth extension angle defined between the second protruding axis and a fourth extension axis;

distributing the second fuel jet into, at least, a third distributed jet and a fourth distributed jet using the second plurality of extension members; and directing, at least, the third distributed jet and the fourth distributed jet into the combustion chamber.

* * * * *